US007872206B2

(12) United States Patent
Matsunaga et al.

(10) Patent No.: US 7,872,206 B2
(45) Date of Patent: Jan. 18, 2011

(54) POWER SUPPLY CIRCUIT CONNECTOR AND METHOD OF CONNECTING POWER SUPPLY CIRCUIT

(75) Inventors: Yasuo Matsunaga, Sagamihara (JP); Kouji Iwashita, Isehara (JP); Shigeo Mori, Makinohara (JP)

(73) Assignees: Nissan Motor Co., Ltd., Yokohama-shi (JP); Yazaki Corporation, Tokyo (JP)

( * ) Notice: Subject to any disclaimer, the term of this patent is extended or adjusted under 35 U.S.C. 154(b) by 309 days.

(21) Appl. No.: 12/013,852

(22) Filed: Jan. 14, 2008

(65) Prior Publication Data

US 2008/0185276 A1 Aug. 7, 2008

(30) Foreign Application Priority Data

Jan. 17, 2007 (JP) ..... 2007-007737

(51) Int. Cl.
*H01H 3/04* (2006.01)

(52) U.S. Cl. ..... 200/335; 439/157; 439/188

(58) Field of Classification Search ..... 439/157, 439/188; 200/335, 332, 559
See application file for complete search history.

(56) References Cited

U.S. PATENT DOCUMENTS 6,580,045 B1 * 6/2003 Kuo ..... 200/559
6,672,887 B1 * 1/2004 Yu ..... 439/108
6,755,673 B2 6/2004 Fukushima et al.
6,982,393 B2 1/2006 Matsui et al.
7,445,491 B2 * 11/2008 Fujii et al. ..... 439/489
2005/0098419 A1 * 5/2005 Matsui et al. ..... 200/311

FOREIGN PATENT DOCUMENTS

JP 2002-343169 A 11/2002
JP 2003-100382 A 4/2003
JP 2003-100386 A 4/2003
JP 2005-142107 A 6/2005

* cited by examiner

*Primary Examiner*—Edwin A. Leon
(74) *Attorney, Agent, or Firm*—Foley & Lardner LLP

(57) ABSTRACT

A power supply circuit connector includes: a first housing including: a pair of main circuit terminals connected with each other via a first switch terminal, and a pair of mated state sensor terminals connected with each other; a second housing mated with or detached from first housing, second housing including: first switch terminal for connecting the pair of main circuit terminals by a lever rotated to a first certain position; the lever rotatably supported to second housing and including: a second switch terminal for making the following operation: with the pair of main circuit terminals kept connected with each other, connecting the pair of mated state sensor terminals with each other by lever rotated to a second certain position after first certain position; and a mating-detaching mechanism for making the following operations by rotated lever: mating second housing with the first housing, and detaching second housing from the first housing.

15 Claims, 13 Drawing Sheets

POWER SUPPLY CIRCUIT CONNECTOR AND METHOD OF CONNECTING POWER SUPPLY CIRCUIT

BACKGROUND OF THE INVENTION

1. Field of the Invention

The present invention relates to a power supply circuit connector for breaking or connecting a power supply circuit of a hybrid car, an electric car and the like. The present invention also relates to a method of connecting the power supply circuit.

2. Description of the Related Art

For operational safety of a hybrid car or an electric car, it is necessary to implement maintenance and the like in a state that a power supply circuit is manually broken (cut off). U.S. Pat. No. 6,982,393 {family of Japanese Patent Application Laid-Open No. 2005-142107 (=JP2005142107)} discloses a known device for breaking the above power supply circuit.

The device of U.S. Pat. No. 6,982,393 has the following operations: Rotating a lever allows one connector housing to be received in another connector housing, thus connecting main circuit terminals with each other.

Moreover, sliding the one connector housing in the another connector housing connects mated state sensor terminals, thereby bringing the power supply circuit into a conduction state.

SUMMARY OF THE INVENTION

It is an object of the preset invention to provide a power supply circuit connector which allows a rotation of a lever to connect a pair of main circuit terminals with each other and to connect a pair of mated state sensor terminals with each other, keeping small-sized power supply circuit connector.

It is another object of the present invention to provide a method of connecting the power supply circuit.

According to a first aspect of the present invention, there is provided a power supply circuit connector of a power supply circuit, the power supply circuit connector comprising: a first housing including: a pair of main circuit terminals adapted to be connected with each other via a first switch terminal, for bringing a power supply circuit into a conduction state, and a pair of mated state sensor terminals adapted to be connected with each other, for bringing the power supply circuit into the conduction state; a second housing configured to mate with or to be detached from the first housing, the second housing including: the first switch terminal configured to connect the pair of the main circuit terminals by means of a lever rotated to a first certain position; the lever rotatably supported to the second housing, the lever including: a second switch terminal configured to make the following operation: in a state that the pair of the main circuit terminals are kept connected with each other, connecting the pair of the mated state sensor terminals with each other by means of the lever rotated to a second certain position after the first certain position; and a mating-detaching mechanism configured to make the following operations by means of the rotated lever: mating the second housing with the first housing, and detaching the second housing from the first housing.

According to a second aspect of the present invention, there is provided a power supply circuit connector of a power supply circuit, the power supply circuit connector comprising: a housing including: a first switch terminal configured to connect a pair of main circuit terminals of another housing by means of a lever rotated to a first certain position; the lever rotatably supported to the housing, the lever including: a second switch terminal having a first part and a second part defining therebetween an inner width which is narrower downward in a right-and-left direction, a lower end part of the second switch terminal being elastically deformable around an upper end part of the second switch terminal on right and left sides; and a guide groove defined in the lever and to which a guide pin is inserted.

According to a third aspect of the present invention, there is provided a method of connecting a power supply circuit, the method comprising: a first operation for engaging a first housing with a lever, the first housing including a pair of main circuit terminals and a pair of mated state sensor terminals while the lever being rotatably supported to a second housing; a second operation including the following sub-operations: rotating the lever to a first certain position to thereby mate the second housing with the first housing, and connecting the pair of the main circuit terminals with each other via a first switch terminal provided in the second housing; and a third operation including the following sub-operations: rotating the lever to a second certain position after the first certain position, connecting the pair of the mated state sensor terminals with each other via a second switch terminal provided in the lever, and bringing the power supply circuit into a conduction state.

Other objects and features of the present invention will become understood from the following description with reference to the accompanying drawings.

BRIEF DESCRIPTION OF THE DRAWINGS

FIG. 4 is a perspective view of the power supply circuit connector in a main circuit mated state, according to the embodiment, where FIG. 4A shows an overall structure of the power supply circuit connector while

FIG. 5A is a perspective view showing a state where the power supply circuit connector is exploded, i.e., completely detached state, while

FIG. 6A is a perspective view of the completely mated state while

FIG. 7A shows a completely mated state, FIG. 7B shows a main circuit mated state, FIG. 7C shows a lever temporarily locked state, and FIG. 7D shows a completely detached state.

FIG. 9B shows the main circuit mated state, and FIG. 9C shows the completely mated state.

DESCRIPTION OF THE PREFERRED EMBODIMENTS

In the following, an embodiment of the present invention will be described in detail with reference to the accompanying drawings.

For ease of understanding, the following description will contain various directional terms, such as left, right, upper, lower, forward, rearward and the like. However, such terms are to be understood with respect to only a drawing or drawings on which the corresponding part of element is illustrated.

Hereinafter, referring to FIG. 1 to FIG. 13, a power supply circuit connector 100 is to be set forth, according to an embodiment of the present invention.

Figure 1:
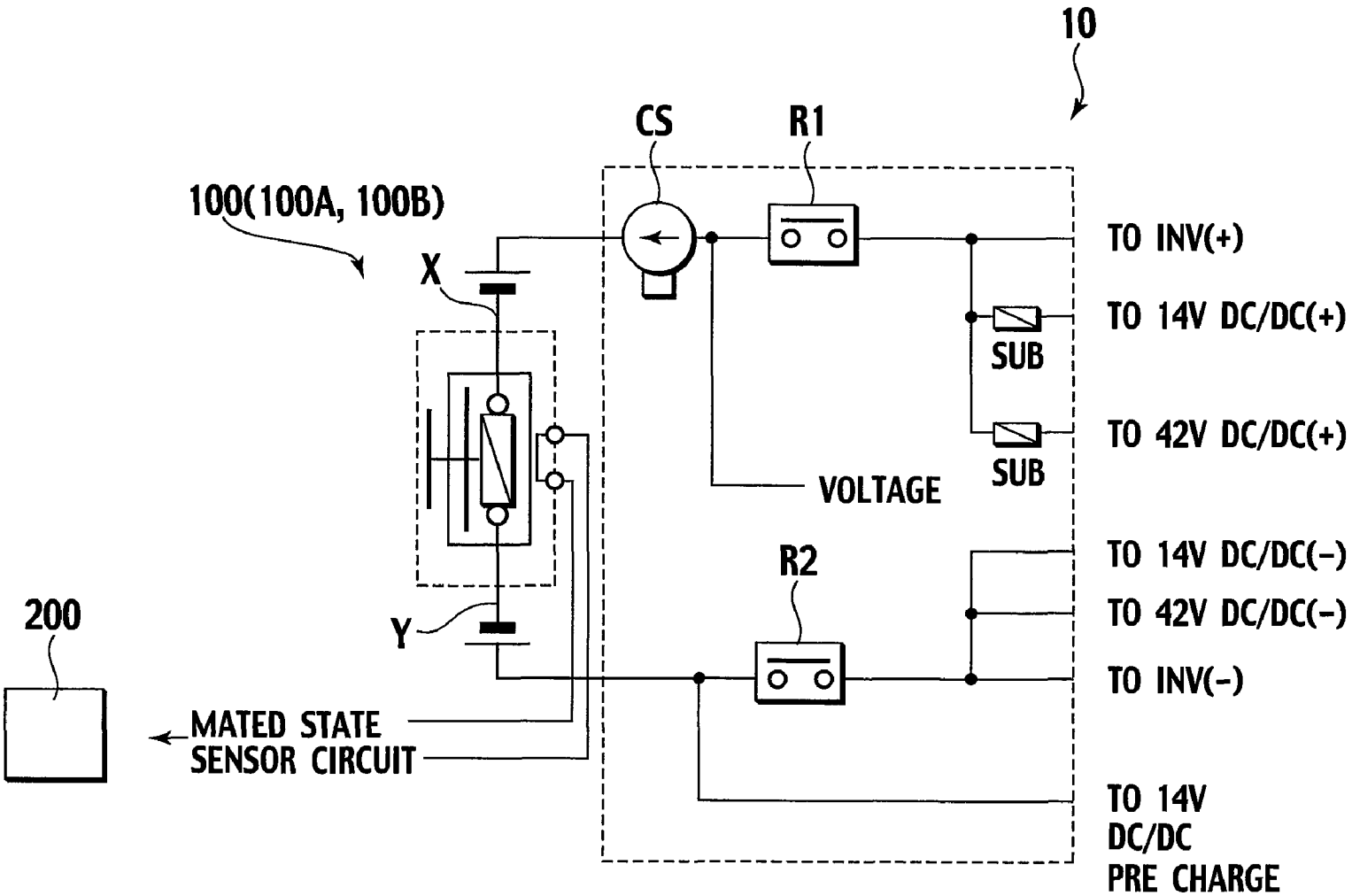
FIG. 1 shows a schematic of an electric circuit diagram of a power supply circuit connector, an according to an embodiment of the present invention.
Figure 2:
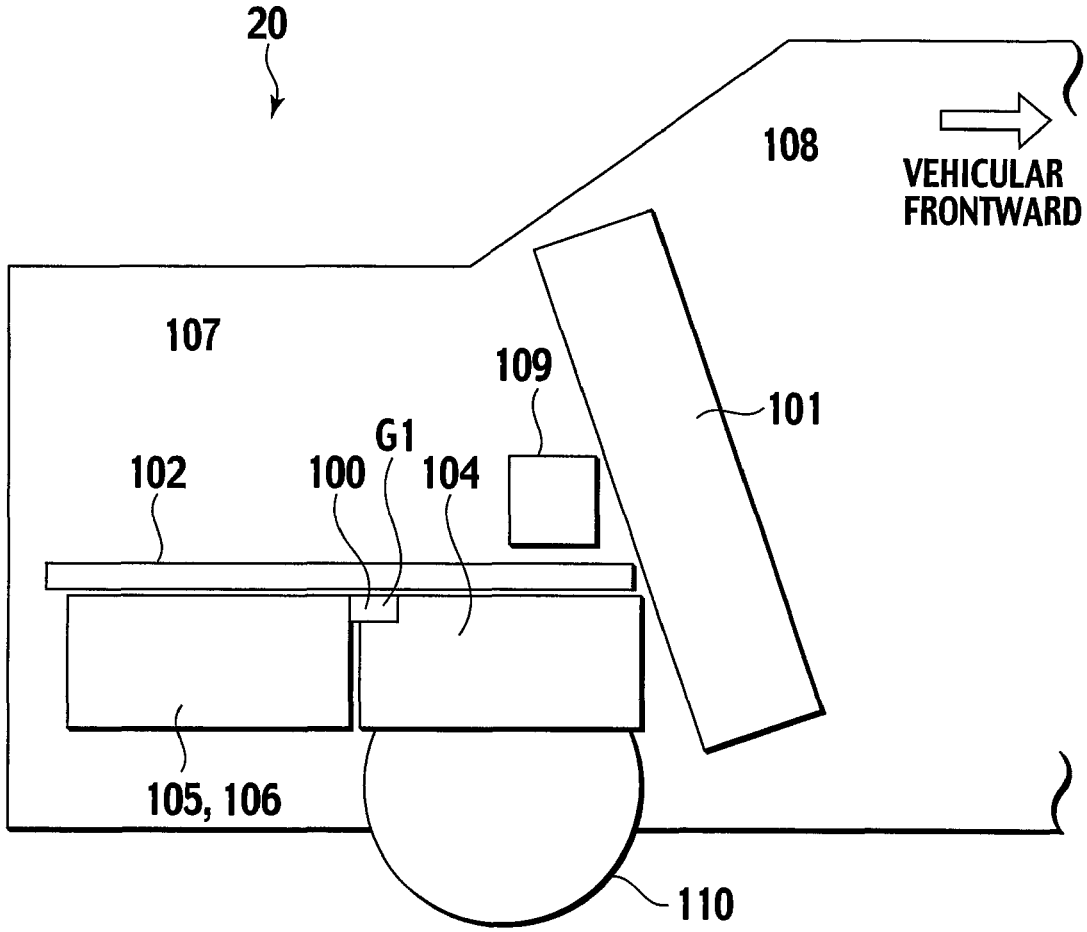
FIG. 2 is a side view of a part of a vehicle, showing where the power supply circuit connector is disposed, according to the embodiment.

FIG. 1 shows a schematic of an electric circuit diagram, showing a part of a power supply circuit 10 of an electric car or a hybrid car (hereinafter referred to as vehicle 20 as shown in FIG. 2). As shown in FIG. 1, the power supply circuit connector 100 (hereinafter referred to as "service disconnecting switch 100" or "SDSW 100" for short) according to the embodiment is provided on a way of the power supply circuit 10 and serves as a main circuit switch 100A for breaking batteries from each other or connecting the batteries with each other. That is, the SDSW 100 has a pair of connector housings (otherwise referred as to "first housing 1" and "second housing 2") which are attachable and detachable, and the attaching and detaching of the connector housings 1, 2 respectively disconnect and connect an intermediate potential part X-Y of a battery—to be described afterward.

An electricity from the battery flows to an inverter INV (denoted but not shown in FIG. 1), a 14 V DC/DC converter (denoted but not shown in FIG. 1) and a 42 V DC/DC converter (denoted but not shown in FIG. 1) via relays R1, R2. The electricity from the battery is sensed with a current sensor CS and a voltage sensor (not shown in FIG. 1).

Not only as the main circuit switch 100A, the SDSW 100 also serves as a mated state sensor switch 100B for sensing a mated state of the pair of the connector housings 1, 2. When a signal from the mated state sensor switch 100B is inputted to an ECU 200 and thereby the mated state of the connector housings 1, 2 is sensed, the ECU 200 turns on the relays R1, R2.

As a result, when the main circuit switch 100A is turned on and also the mated state sensor switch 100B is turned on, the power supply circuit 10 is brought into a conduction state.

Figure 3:
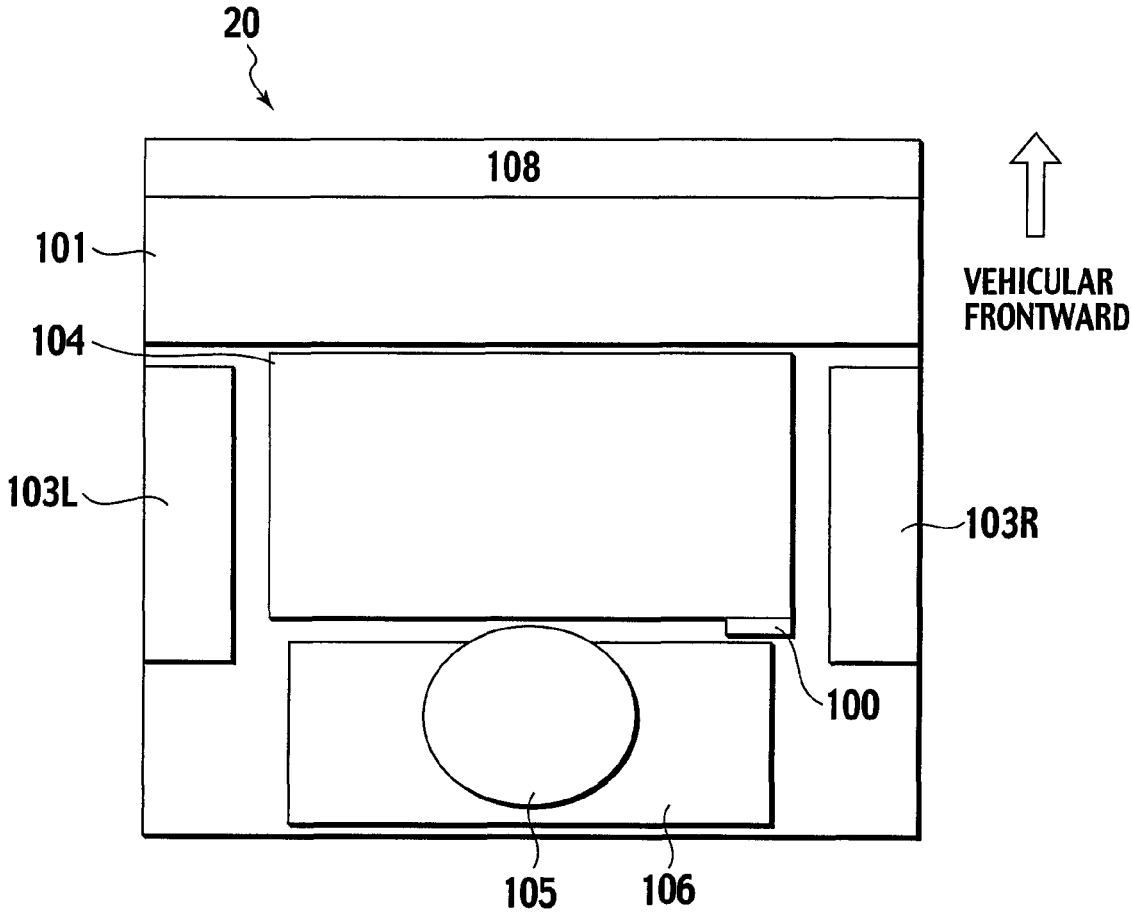
FIG. 3 is a plan view of a part of the vehicle, showing where the power supply circuit connector is disposed, according to the embodiment.

FIG. 2 and FIG. 3 each show where the SDSW 100 is disposed. FIG. 2 is a side view of a part of the vehicle 20 while FIG. 3 is a plan view of a part of the vehicle 20. In a trunk room 107 behind a rear seat back 101 and a gasoline tank 109, a luggage board 102 is laid.

Below the luggage board 102, a battery pack 104 is disposed above a tire 110 and between a right wheel house 103R and a left wheel house 103L. Behind the battery pack 104, a spare tire 105 and an auxiliary machine 106 such as an audio and the like are disposed. The SDSW 100 is disposed in a gap G1 between the battery pack 104 and the auxiliary machine 106.

As described above, various components are disposed below the trunk room 107, leaving a small space. Therefore, it is preferable that the SDSW 100 is as small as possible. Moreover, the SDSW 100 is operated in a maintenance period of a power supply system or in an emergency of the vehicle 20. Therefore, the SDSW 100 should have a preferable operability even when being disposed in a place that is not preferable for operation, i.e., below the luggage board 102.

Moreover, the SDSW 100 has such a structure that the connector housings 1, 2 should not be detached by a vehicular vibration and the like during travel period. To meet the above, the SDSW 100 according to the embodiment has a structure set forth below.

<Structure of SDSW 100>

Figure 4A:
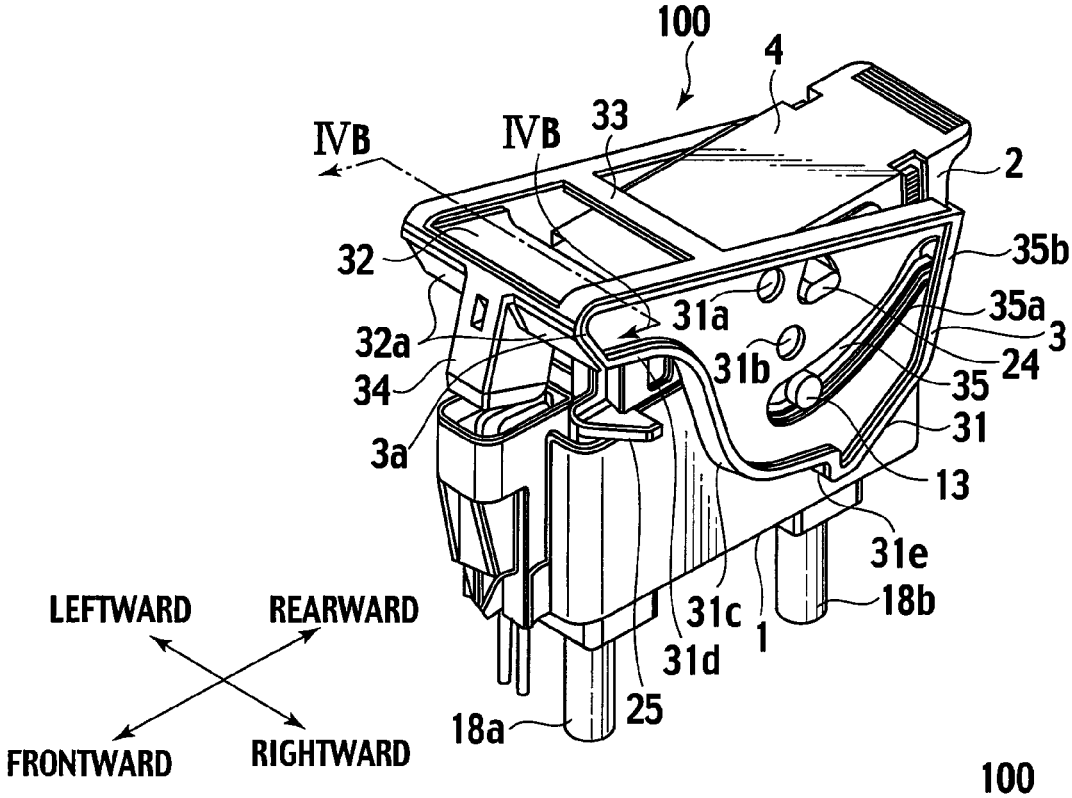
Figure 4B:
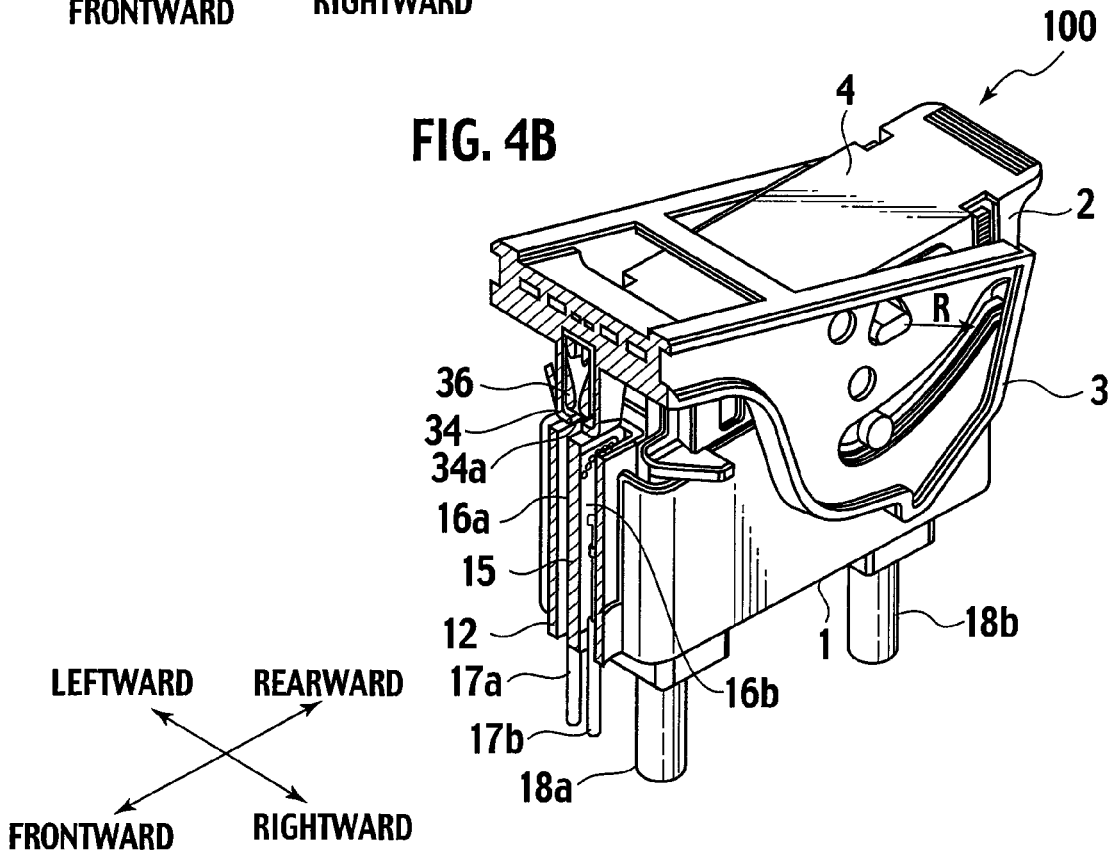
FIG. 4B shows the power supply circuit connector partly cut.

FIG. 4A is a perspective view showing an overall structure of the SDSW 100 (main circuit mated state), according to the embodiment. FIG. 4B is a view of the SDSW 100 cut along the line IVB-IVB in FIG. 4A.

Figure 5B:
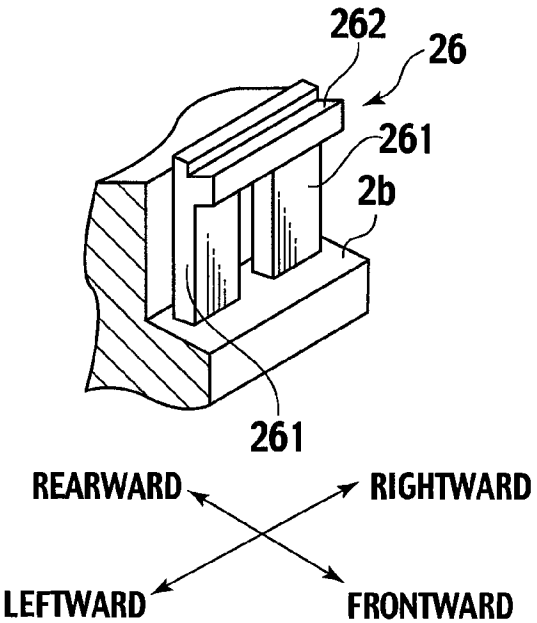
FIG. 5B is a perspective view of an essential part of FIG. 5A, according to the embodiment.
Figure 5A:
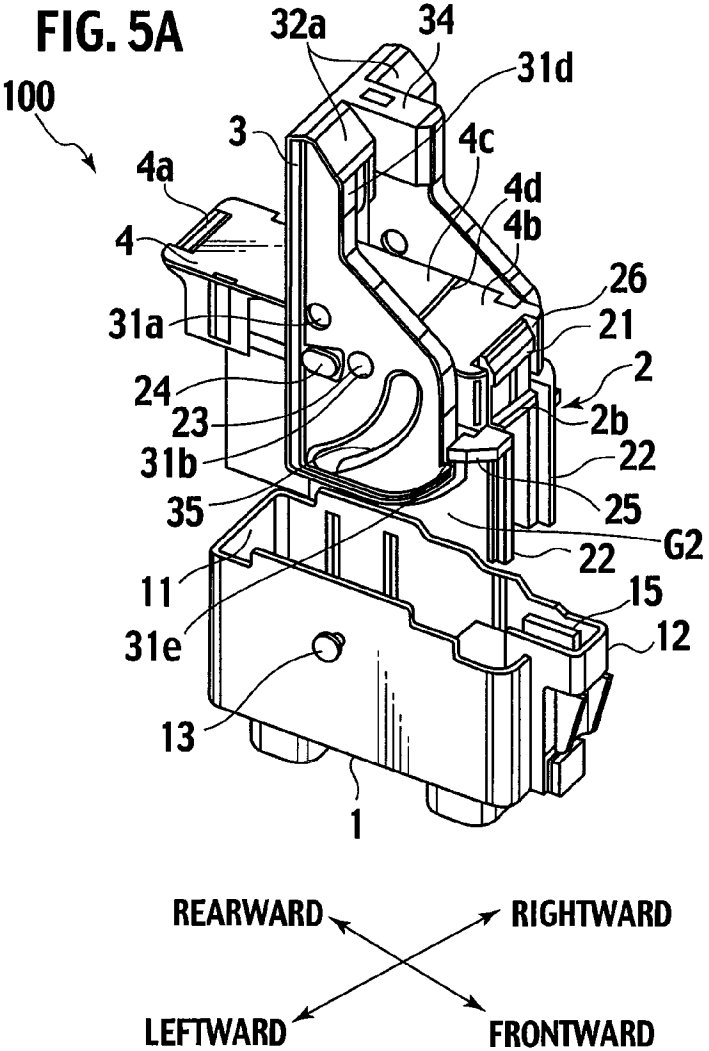

FIG. 5A is a perspective view showing a state where the SDSW 100 is exploded (completely detached state). FIG. 5B is a perspective view of an essential part of FIG. 5A. Besides, hereinafter, for ease of explanation and for convenience sake, front, rear, left and right are defined as shown in FIG. 4A, FIG. 4B, FIG. 5A and FIG. 5B.

The SDSW 100 has a first housing 1 fixed to the vehicle 20 and a second housing 2 configured to be received in the first housing 1. A lever 3 rotatable upward and downward is fitted to the second housing 2. Rotation of the lever 3 pushes the second housing 2 into the first housing 1, allowing the second housing 2 to mate with the first housing 1 and allowing a head end part 3*a* of the lever 3 to mate with the first housing 1. As such, the above described main circuit switch 100A and mated state sensor switch 100B are turned on. Each of the first housing 1, the second housing 2 and the lever 3 is made of resin.

As shown in FIG. 5A, a cover 4 is mounted above the second housing 2. Holding a holding part 4*a* at a rear end part of the cover 4 and then pulling the holding part 4*a* rearward can remove the cover 4. With the cover 4 thus removed, replacement and the like of components received in the cover 4 are implemented. An upper face of the cover 4 has a step 4*d*, making a front upper part 4*b* of the cover 4 lower than a rear upper part 4*c* of the cover 4.

An upper part (an upper housing 21) of the second housing 2 is so formed as to be wider than a lower part (a lower housing 22) in the right-left direction. On each of a right sideface and a left sideface of the upper housing 21, a positioning protrusion 23, a rotary shaft 24 and a stopper 25 are disposed in such a configuration as to each protrude. Moreover, a step part 2*b* is disposed on a front end face of the second housing 2. A locking member 26 stands on the step part 2*b*.

As shown in FIG. 4A, FIG. 4B and FIG. 5A, the lever 3 has a first connector member 32 and a second connector member 33 each of which couples a pair of right and left arm plates 31, 31 with each other. In a right-left center of the first connector member 32, a connector part 34 (otherwise referred to as "inserted connector part 34") is provided in such a configuration as to protrude in the direction of rotating the lever 3. A taper part 32*a* is formed on either side of the connector part 34. The rotary shaft 24 of the upper housing 21's sideface passes through the arm plate 31. Thereby, the lever 3 is supported in such a configuration as to rotate around the rotary shaft 24. In the right-left direction, a gap G2 is defined between the lever 3 and the lower housing 22. The first housing 1 is inserted into the gap G2.

The arm plate 31 has a pair of positioning hole parts 31*a*, 31*b*. Inserting the positioning protrusion 23 on the upper housing 21 's sideface into any of the positioning hole parts 31*a*, 31*b* stops the lever 3 in a certain rotary position (completely detached position). In this case, inserting the positioning protrusion 23 into the hole part 31*b* allows the lever 3 to stand substantially vertically, as shown in FIG. 5A. This is defined as a completely detached state. In the completely detached state, the main circuit switch 100A and the mated state sensor switch 100B each are turned off—to be described afterward.

Figure 6B:
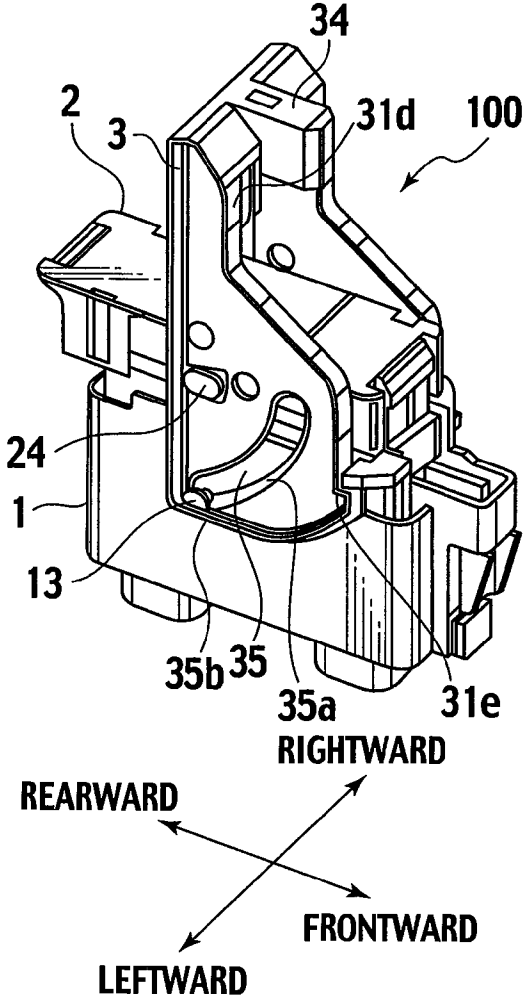
FIG. 6B is a perspective view of the lever temporarily locked state.
Figure 6A:
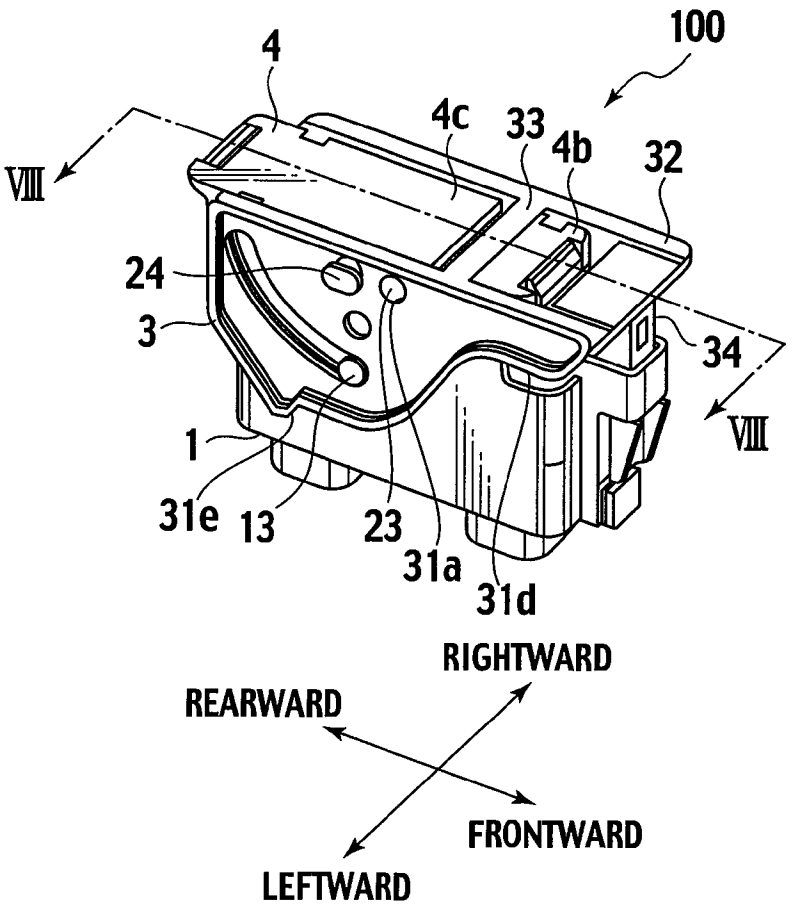

As shown in FIG. 6A (completely mated state), inserting the positioning protrusion 23 into the hole part 31*a* allows an upper end face of the lever 3 to be substantially parallel to an upper face of the cover 4, thus positioning the second connector member 33 of the lever 3 above the front upper part 4*b* of the cover 4. This is defined as a completely mated state, and the position of the lever 3 in the completely mated state is defined as a completely mated position (otherwise referred to as "second certain position P2"). In the completely mated state, the connector part 34 of the lever 3 is positioned frontward relative to the second housing 2, turning on both of the main circuit switch 100A and the mated state sensor switch 100B—to be described afterward.

FIG. 4A (likewise FIG. 4B) shows a state in the process from the completely detached state to the completely mated state. This is defined as a main circuit mated state. The position of the lever 3 in the main circuit mated state is defined as a main circuit mated position (otherwise referred to as "first certain position P1"). In the main circuit mated state, the main circuit switch 100A is turned on while the mated state sensor switch 100B is turned off—to be described afterward.

As shown in FIG. 4A and FIG. 4B, a part of a periphery of the arm plate 31 is formed substantially into an arc (arc part 31*c*) around the rotary shaft 24. Latch parts 31*d*, 31*e* are formed at respective ends of the arc part 31*c*. The latch parts 31*d*, 31*e* caused to abut on the stopper 25 on the upper housing 21's sideface limit the lever 3's rotary range to between the completely mated position (second certain position P2) and the completely detached position.

As shown in FIG. 5A, the first housing 1 has a receiver 11 for receiving the second housing 2. At a front part of the receiver 11, a connector part 12 (otherwise referred to as "receiving connector part 12") is provided in such a configuration as to correspond to the connector part 34 of the lever 3. A guide pin 13 (otherwise referred to as "mating-detaching mechanism" in combination with guide groove 35) protrudes on each of right and left outer sidefaces of the first housing 1. The receiver 11 is so formed as to correspond to a profile of the lower housing 22. The lower housing 22 alone is received in the receiver 11 while the upper housing 21 protrudes from the receiver 11.

A substantially arc guide groove 35 (otherwise referred to as "mating-detaching mechanism" in combination with guide pin 13) is formed in the arm plate 31 of the lever 3. As shown in FIG. 4A (likewise FIG. 4B), on a right-left inner face of the arm plate 31, a guide part 35*a* protrudes along the guide groove 35. The guide part 35*a* is formed in a position other than a peripheral part 35*b* of the arm plate 35. As shown in FIG. 6B in combination with FIG. 5A, only from the completely detached state, the guide pin 13 can be inserted into the guide groove 35 via the peripheral part 35*b* apart from the guide part 35*a*. Herein, FIG. 6B shows a state where the guide pin 13 is locked to an end part of the guide groove 35, bringing about a lever temporarily locked state.

Figure 7A:
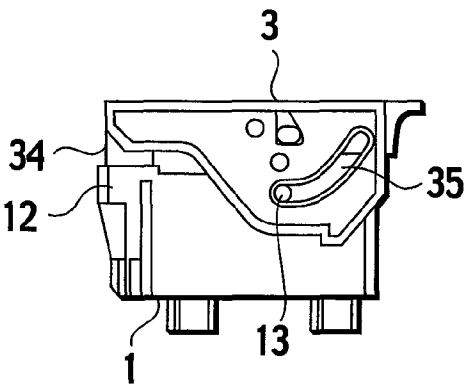
FIG. 7A, FIG. 7B, FIG. 7C and FIG. 7D show a guide groove relative to a guide pin in respective states of the power supply circuit connector, where
Figure 7B:
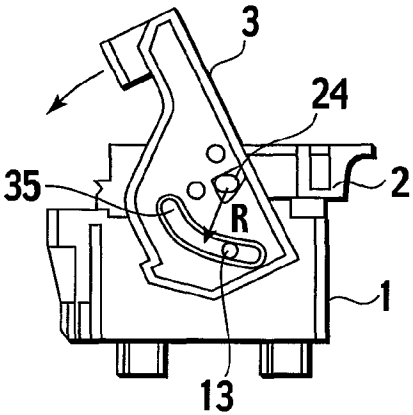
Figure 7C:
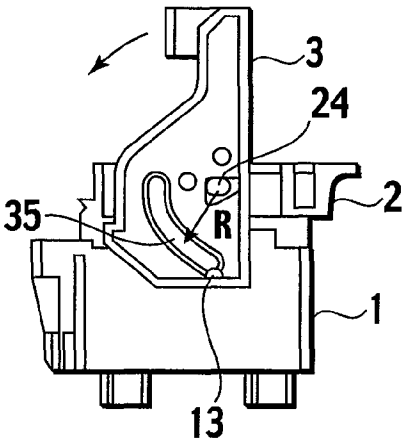
Figure 7D:
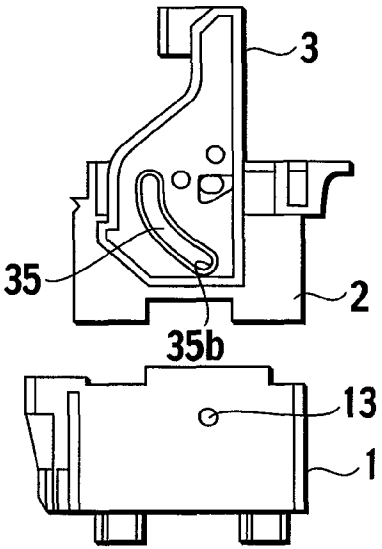

FIG. 7A, FIG. 7B, FIG. 7C and FIG. 7D show the guide groove 35 relative to the guide pin 13 in respective states of the SDSW 100, where FIG. 7A shows the completely mated state, FIG. 7B shows the main circuit mated state, FIG. 7C shows the lever temporarily locked state, and FIG. 7D shows the completely detached state.

As shown in FIG. 7D, in the completely detached state, an end part (the peripheral part 35*b*) of the guide groove 35 is open downward. In the completely detached state, the guide groove 35 is formed straightly upward by a certain distance from the peripheral part 35*b*. As such, inserting the second housing 2 from upward into the first housing 1 engages the guide pin 13 with the guide groove 35, leading to the lever temporarily locked state shown in FIG. 7C.

In the lever temporarily locked state in FIG. 7C, rotating the lever 3 in an arrow direction (downward and counterclockwise) in FIG. 7C moves the guide groove 35 along the guide pin 13, leading to the main circuit mated state shown in FIG. 7B. The guide groove 35 is so formed that a distance R from the rotary shaft 24 for the lever 3 to the guide groove 35 becomes gradually smaller from the lever temporarily locked state in FIG. 7B to the main circuit mated state in FIG. 7A. As such, rotation of the lever 3 works for pushing the second housing 2 into the first housing 1.

Then, in the main circuit mated state in FIG. 7B, rotating the lever 3 in the arrow direction (downward and counterclockwise) moves the guide groove 35 along the guide pin 13, leading to the completely mated state shown in FIG. 7A. The guide groove 35 is so formed that the distance R from the rotary shaft 24 for the lever 3 to the guide groove 35 is constant from the main circuit mated state in FIG. 7B to the completely mated state in FIG. 7A. As such, rotation of the lever 3 can prevent the second housing 2 from being pushed any further and the lever 3 alone moves, allowing the connector part 34 of the lever 3 to mate with the connector part 12 of the first housing 1.

<Inner Structure of SDSW 100>

Figure 8:
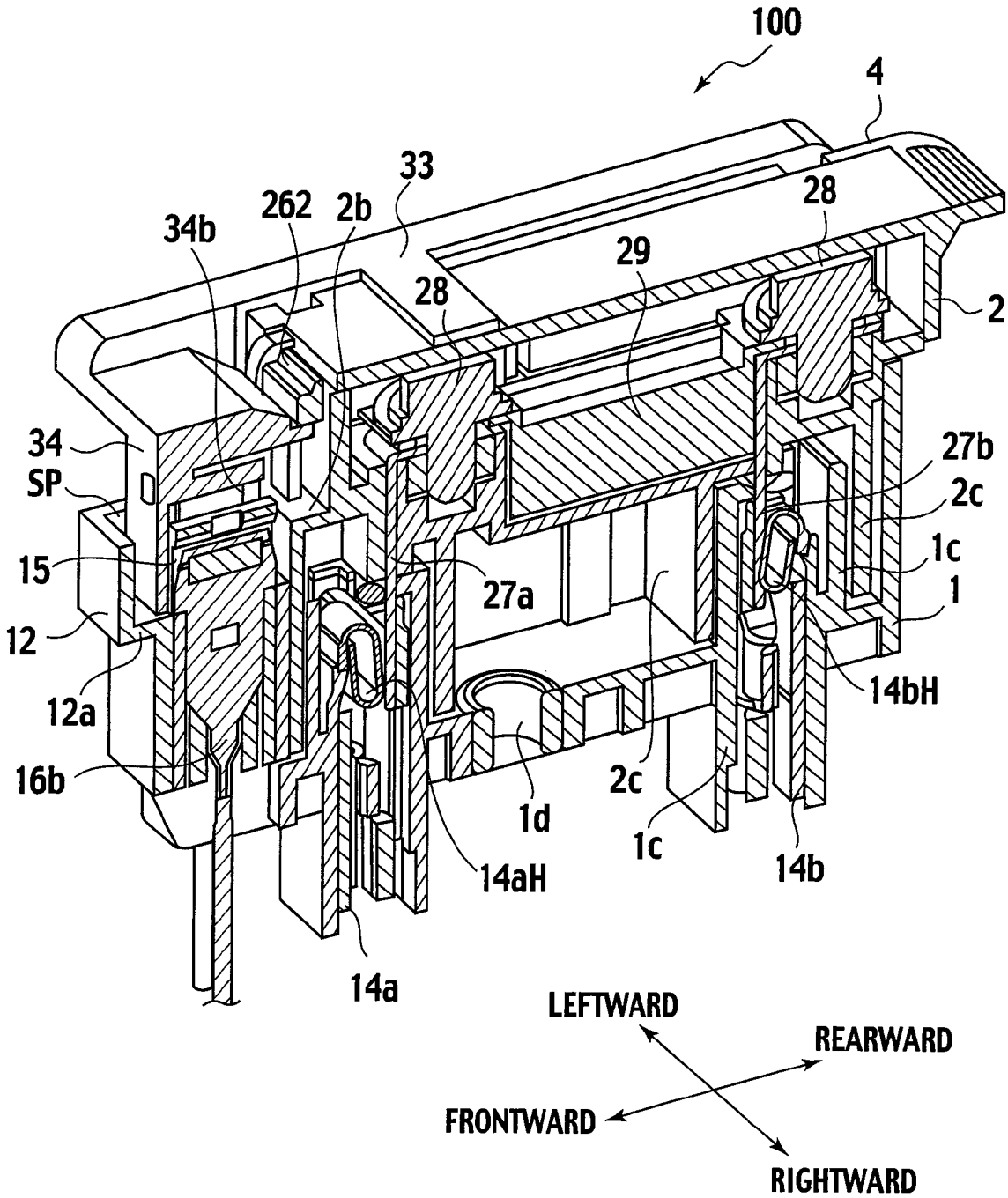
FIG. 8 a cross sectional view taken along the line VIII-VIII in FIG. 6A.

FIG. 8 is a cross sectional view of the SDSW 100 taken along the line VIII-VIII in FIG. 6A. Referring to FIG. 8, an inner structure of the SDSW 100 is to be set forth. A fuse 29 is disposed inside the cover 4 of the second housing 2. A pair of thin plate terminals 27*a*, 27*b* (otherwise referred to as "first switch terminals") are connected at respective ends of the fuse 29 in the frontward-rearward direction, where a bolt 28 is used for fixing the fuse 29 to each of the first switch terminals 27*a*, 27*b*. Being bent into an alphabetical L upside down in FIG. 8, each of the first switch terminals 27*a*, 27*b* passes through a base face of the second housing 2. A case part 2*c* protrudes from a base face of the second housing 2, covering a periphery of each of the first switch terminals 27*a*, 27*b*. The first switch terminals 27*a*, 27*b* each have a length that is so specified that a head end of each of the first switch terminals 27*a*, 27*b* does not protrude more downward than the case part 2*c*.

A pair of thin plate terminals 14*a*, 14*b* (otherwise referred to as "main circuit terminals") pass through a base face of the first housing 1. Corresponding to the case part 2*c* of the second housing 2, a case part 1*c* protrudes on an inner base face of the first housing 1. The terminals 14*a*, 14*b* each have a length that is so specified that a head end of each of the terminals 14*a*, 14*b* does not protrude more upward than the case part 1*c*. The case part 1*c* of the first housing 1 is received in the case part 2*c* of the second housing 2.

Head end parts 14*a*H, 14*b*H of the respective main circuit terminals 14*a*, 14*b* are each bent into an alphabetical R. each forming a plate spring. A head end of each of the first switch terminals 27*a*, 27*b* is pushed between the respective main circuit terminals 14*a*, 14*b* and the case part 1*c*, thus allowing the terminal 14*a* to contact the terminal 27*a* and the terminal 14*b* to contact the terminal 27*b*. As such, the main circuit terminals 14*a*, 14*b* can be connected with each other via the first switch terminals 27*a*, 27*b* and the fuse 29, thus turning on the main circuit switch 100A. Besides, the main circuit terminals 14*a*, 14*b* are respectively connected with cables 18*a*, 18*b* (see FIG. 4A or FIG. 4B). A bolt through hole 1*d* for mounting the first housing 1 to the vehicle 20 is provided on the base face of the first housing 1.

As shown in FIG. 4B, a terminal 36 (otherwise referred to as "second switch terminal") having a cross section shaped substantially into an alphabetical U is mounted in the connector part 34 (otherwise referred to as "inserted connector part 34") of the lever 3. The second switch terminal 36 has a length that is so specified that the second switch terminal 36 does not protrude from an opening end face 34*a* below the connector part 34. As such, the connector part 34 covers a periphery of the terminal 36. The second switch terminal 36 has a first part and a second part defining therebetween an inner width which is narrower downward in a right-and-left direction. A lower end part of the second switch terminal 36 is elastically deformable around an upper end part of the terminal 36 outwardly on right and left sides (see FIG. 11). As shown in FIG. 8, on a rear face of the connector part 34, an opening part 34*b* is defined continuously with the opening end face 34*a*, thus opening the lower face and rear face of the connector part 34.

Figure 11:
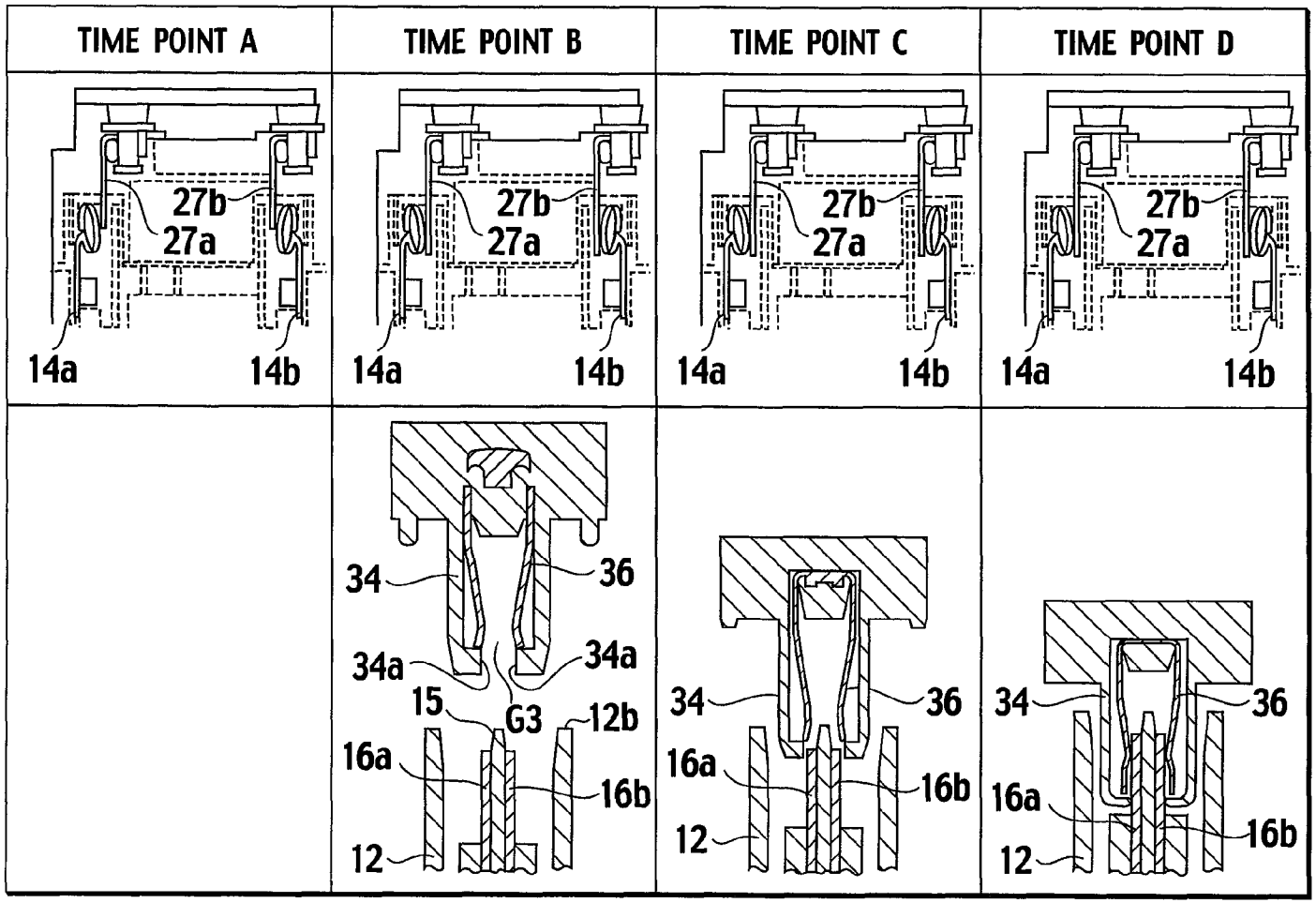
FIG. 11 shows operations corresponding to respective time points A to D of the time chart in FIG. 10.

A base plate 15 is fixed in the connector part 12 (otherwise referred to as "receiving connector part 12") of the first housing 1. The base plate 15 extends upward and downward, with respective left and right faces thereof fitted with plate terminals 16*a*, 16*b* (otherwise referred to as "mated state sensor terminals"), as shown in FIG. 11. The base plate 15 has a length that is so specified that the base plate 15 does not protrude more upward than the connector part 12. As such, the connector part 12 covers the periphery of the base plate 15.

In other words, the mated state sensor terminals 16*a*, 16*b* are provided in the receiving connector part 12 in such a configuration as not to protrude from an opening end face 12*b* of the receiving connector part 12.

An upper end part of the base plate 15 is formed into an alphabetical R. Via the upper end part, the base plate 15 mates in a gap G3 between right and left extensions of the terminal 36.

Besides, the terminals 16*a*, 16*b* are connected respectively with cables 17*a*, 17*b* shown in FIG. 4B.

In FIG. 8, the connector part 34 is completely received in the connector part 12 of the first housing 1. In this state, the base plate 15 mates in the terminal 36, allowing the terminal 36 to contact the terminals 16*a*, 16*b*. As such, the terminals 16*a*, 16*b* are connected with each other via the terminal 36, thus turning on the mated state sensor switch 100B.

Besides, in FIG. 8, a step part 12*a* is provided on the front face of the connector part 12 of the first housing 1. The step part 12*a* defines a space SP between the connector part 12 and the front end face of the base plate 15. The space SP has such a scale that, for receiving the connector part 34 in the connector part 12 by rotating the lever 3, an angled part of the connector part 34 does not interference with the connector part 12.

According to embodiment, the second housing 2 has the locking member 26 which is so configured as to implement the following operations: Rotation of the lever 3 is once stopped in the main circuit mated position (first certain position P1) (see FIG. 4A), then, the lever 3 is rotated to the completely mated position (second certain position P2) (see FIG. 6A), such that the lever 3 can be locked.

Hereinafter, the locking member 26 is to be set forth.

<Structure of Locking Member 26>

As shown in FIG. 5B and FIG. 8, the locking member 26 has:

a support plate 261 standing on the upper face of the step part 2*b* at the front end face of the second housing 2, and a nail part 262 provided at an upper end part of the support plate 261 and extending in right-left direction.

Each of the divided right support plate 261 and left support plate 261 has a plate thickness which is thin in the frontward and rearward directions. Therefore, bending rigidity of the support plate 261 in the frontward and rearward directions is low. As such, the support plate 261 is elastically deformable in the frontward and rearward directions.

<Operation of Locking Member 26>

Figure 9A:
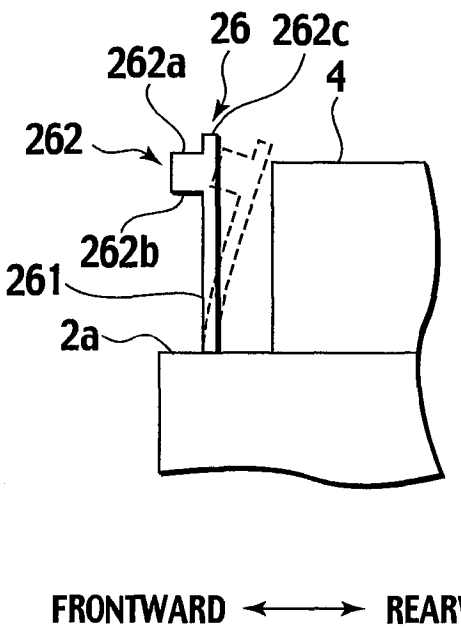
FIG. 9A, FIG. 9B and FIG. 9C each are an enlarged side view of the locking member 26 in operation, where
Figure 9B:
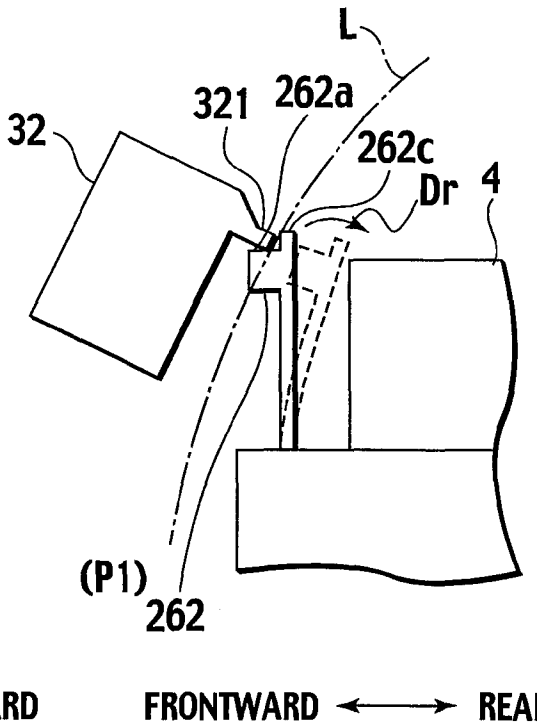
Figure 9C:
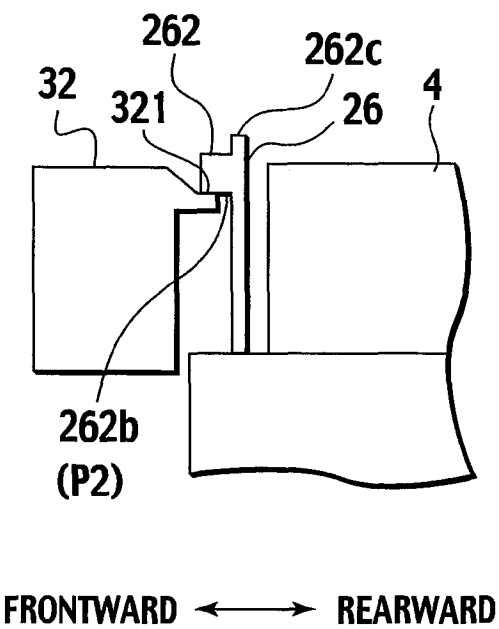

FIG. 9A, FIG. 9B and FIG. 9C each are an enlarged side view of the locking member 26 in operation, where FIG. 9B shows the main circuit mated state, and FIG. 9C shows the completely mated state.

As shown in FIG. 9A, the nail part 262 has an upper face 262*a* and a lower face 262*b* which are formed substantially horizontal. The nail part 262 protrudes more frontward than the support plate 261, and protrudes more upward than the upper face of the cover 4. Around a lower end part of the support plate 261, the locking member 26 is elastically deformable rearward, as depicted by a broken line.

FIG. 9B shows the locking member 26 in the main circuit mated state in combination with the lever 3's first connector member 32 contacting the locking member 26. On the rear end face of the first connector member 32, a protrusion 321 is provided corresponding to the nail part 262. In the main circuit mated state in FIG. 9B, the nail part 262 is positioned on a rotation track L of the first connector member 32. As such, the protrusion 321 abuts on the upper face 262*a* of the nail part 262, preventing downward rotation of the lever 3.

The upper face of the protrusion 321 of the first connector member 32 is tapered rearward. Therefore, an upper end 262*c* of the nail part 262 protrudes more upward than the protrusion 321, allowing a finger to push rearward the upper end 262*c* of the nail part 262. In the main circuit mated state in FIG. 9B, pushing rearward (rotary direction Dr) the upper end 262*c* elastically deforms the locking member 26 as depicted by the broken line, thus removing the nail part 262 reward out of the rotation track L of the first connector member 32. As such, nothing prevents the rotation of the lever 3, thus rotating the lever 3 more downward.

After the rotating of the lever 3, removing the finger from the nail part 262 returns the locking member 26 to an original position by means of an elastic force, as shown in FIG. 9C. This state is defined as the completely mated state. In the completely mated state, the upper face of the protrusion 321 is positioned beneath the lower face 262*b* of the nail part 262. As such, an upward rotation of the lever 3 can be prevented, thus locking the lever 3.

Besides, for moving from the completely mated state to the main circuit mated state, the upper end 262*c* of the locking member 26 is pushed rearward with the finger to thereby remove the nail part 262 rearward, thus rotating the lever 3 upward.

<Method of Bringing SDSW 100 into Mated State>

A method of bringing the SDSW 100 into the mated state is to be set forth.

Figure 10:
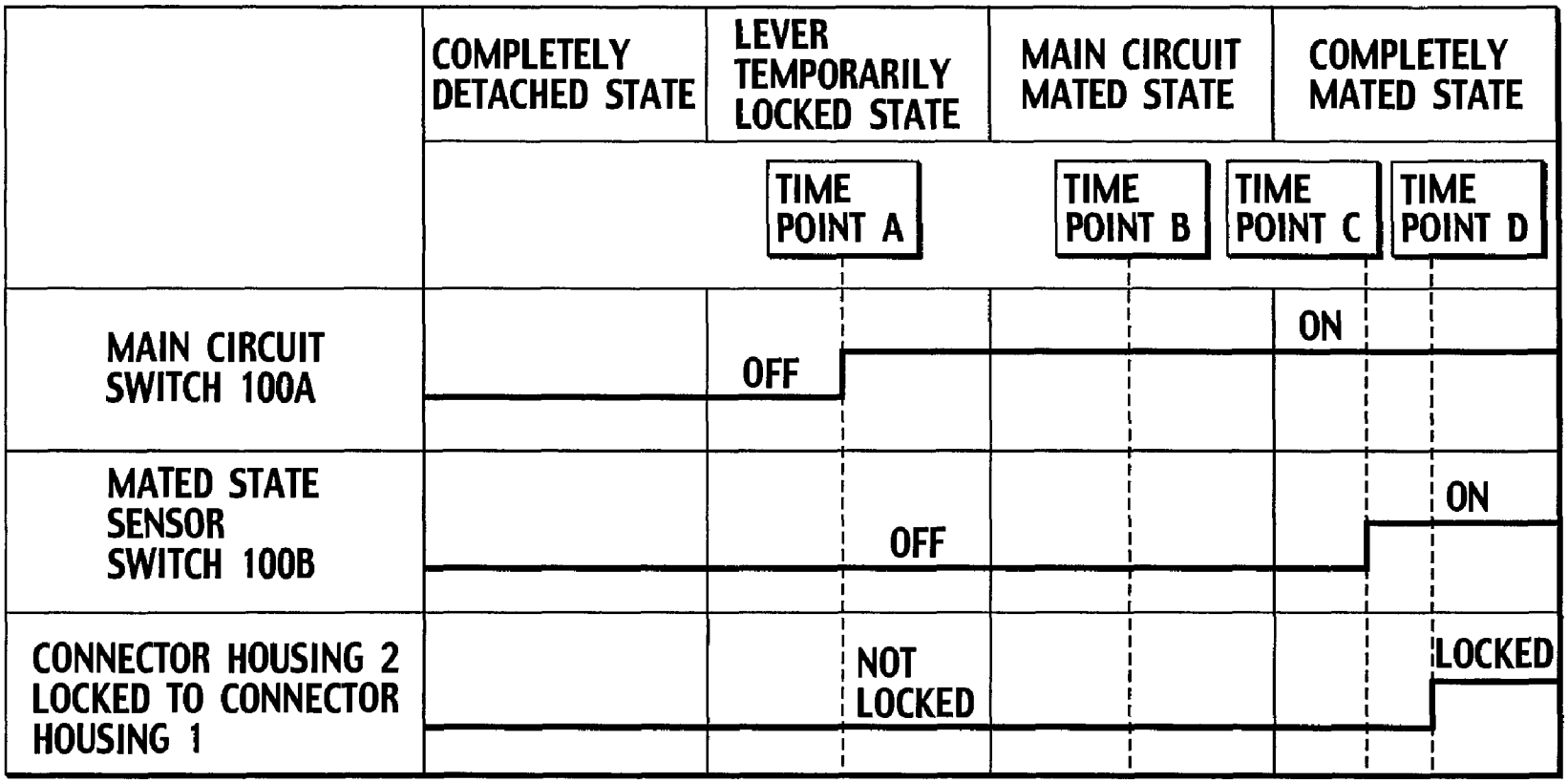
FIG. 10 is a time chart showing state changes of the power supply circuit connector for bringing a power supply circuit into the conduction state.

FIG. 10 is a time chart showing state changes of the SDSW 100 for bringing the power supply circuit 10 into the conduction state.

FIG. 11 shows operations corresponding to respective time points A to D of the time chart in FIG. 10.

For implementing maintenance and the like of the power supply system, the SDSW 100 should be in the completely detached state. In the completely detached state, the main circuit switch 100A is turned off and the mated state sensor switch 100B is turned off, thus unlocking the first and second connector housings 1, 2 of the SDSW 100.

(Time Point A)

In the completely detached state, inserting the first housing 1 into the second housing 2 and thereby inserting the guide pin 13 into the guide groove 35 brings about the lever temporarily locked state (time point A). In the lever temporarily locked state, as shown in FIG. 11, the first switch terminals 27*a*, 27*b* of the second housing 2 respectively contact the main circuit terminals 14*a*, 14*b* of the first housing 1, thus turning on the main circuit switch 100A.

(Time Point B)

In the lever temporarily locked state, rotating the lever 3 downward pushes the second housing 2 in the first housing 1. Then, the protrusion 321 of the first connector member 32 is caused to contact the nail part 262 of the locking member 26, thus stopping the rotation of the lever 3, to thereby stop the lever 3 in the main circuit mated position (first certain position P1). In this state, the first switch terminals 27*a*, 27*b* keeping the contact respectively with the main circuit terminals 14*a*, 14*b* are pushed downward while the second switch terminal 36 is kept spaced apart from the mated state sensor terminals 16*a*, 16*b*, thus turning on the main circuit switch 100A and keeping the mated state sensor switch 100B turned off(time point B).

(Time Point C)

In this state, pushing the upper end 262*c* of the locking member 26 rearward deforms the locking member 26 rearward, thus removing the nail part 262 rearward from the rotation track L of the protrusion 321. As such, the lever 3 locked by the locking member 26 is unlocked, thus allowing the lever 3 to be rotatable more downward. With the nail part 262 removed rearward, rotating the lever 3 downward allows the terminal 36 to contact the mated state sensor terminals 16*a*, 16*b*, thus turning on the mated state sensor switch 100B (time point C).

(Time Point D)

Further rotating the lever 3 downward to the completely mated position (second certain position P2) moves the protrusion 321 more downward than the lower face 262*b* of the nail part 262. In this state, the elastic force returns the nail part 262 to the original position. As such, the lever 3 is locked by means of the locking member 26, bringing about the completely mated state (time point D).

Described above is the method of bringing the SDSW 100 into the mated state after the maintenance and the like.

For bringing the SDSW 100 into the detached state for the maintenance and the like of the power supply system, a method having procedures opposite to the above described should be implemented. In this case, engaging an index finger and a middle finger with the taper parts 32*a*, 32*a* (see FIG. 4) provided on respective left and right sides at the lever 3's head end part 3*a* and sandwiching the connector part 34 with the index finger and middle finger can easily rotate the lever 3 upward.

<Operations and Effects>

The SDSW 100 according to the above embodiment can bring about the following operations and effects.

(1) Rotating the lever 3 can mate the second housing 2 in the first housing 1 and thereby mate the connector part 34 of the lever 3 with the connector part 12 of the first housing 1, thus turning on the main circuit switch 100A and the mated state sensor switch 100B.

Therefore, the SDSW 100 can be small in size.

(2) Rotating the lever 3 in one direction turns on or off the main circuit switch 100A and the mated state sensor switch 100B, thus smoothing the operations of the SDSW 100 and accomplishing quick operations of the SDSW 100 in case of emergency and the like.

(3) Providing the locking member 26 on the rotation track L of the lever 3 allows the locking member 26 to once lock (stop) the rotation of the lever 3, thus smoothly accomplishing a transfer to the main circuit mated state where only the main circuit switch 100A is turned on.

(4) Pushing the upper end 262*c* of the locking member 26 rearward thereby removing the locking member 26 from the rotation track L of the lever 3 can smoothly accomplish the transfer from the main circuit mated state to the completely mated state.

(5) With the locking member 26 locking the lever 3 to the completely mated position (second certain position P2), the connector housings (first housing 1, second housing 2) of the SDSW 100 can be prevented from being detached by means of vehicle vibration and the like during the travel period, thus stably bringing the power supply circuit 10 into the conduction state.

(6) The second switch terminal 36 is so configured as not to protrude from the opening end face 34*a* of the inserted connector part 34, while the mated state sensor terminals 16*a*, 16*b* (or the base plate 15) are so configured as not to protrude from the opening end face 12*b* of the receiving connector part 12. Thereby, the terminals 36, 16*a*, 16*b* can be prevented from contacting any obstacle and the like in the detaching of the second housing 2 from the first housing 1, thus protecting the terminals 36, 16*a*, 16*b*.

(7) It is not necessary to slide the connector housings (first housing 1, second housing 2). Therefore, an extra receiving space in the housings is not necessary, thus preventing dust entry and the like in the SDSW 100.

(8) The gap G3 between right and left extensions of the second switch terminal 36 becomes narrower downward, thus narrowing down the gap G3 at an inlet of the second switch terminal 36, to thereby prevent the dust entry.

(9) In continuation with the opening end face 34*a* of the connector part 34, the opening part 34*b* is defined at the rear part of the connector part 34, thus easily removing the dust that may have entered the second switch terminal 36. In the completely mated state, the opening part 34*b* is bidden, thus preventing dust entry through the opening part 34*b*.

Although the present invention has been described above by reference to the certain embodiment, the present invention is not limited to the embodiment described above. Modifications and variations of the embodiment described above will occur to those skilled in the art, in light of the above teachings.

Figure 12A:
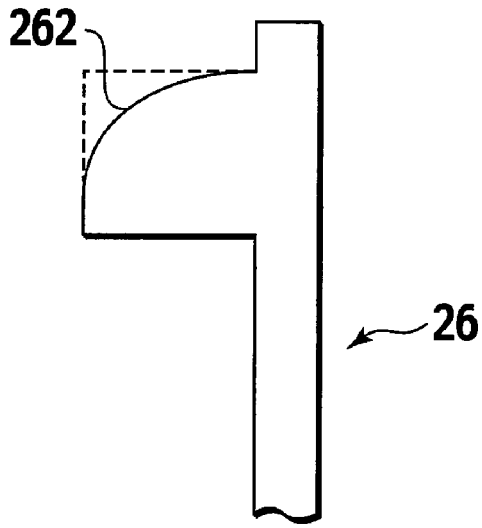
FIG. 12A and FIG. 12B show an examples of deforming a locking member.

According to the embodiment, the nail part 262 of the locking member 26 has a cross section substantially rectangular (see FIG. 9). However, not limited to the rectangle, the locking member 26 may have such a configuration that, for example, an upper part of the nail part 262 is shaped into an alphabetical R, as shown in FIG. 12A.

As such, during the time for rotating the lever 3, the protrusion 321 pushes the locking member 26 rearward. Therefore, it is not necessary to use the finger for pushing the upper end part of the locking member 26 rearward, thus smoothing the mating of the SDSW 100.

In this case, the force for rotating the lever 3 is increased when the protrusion 321 rides over the nail part 262, thereby once stopping the lever 3 in the main circuit mated state.

Otherwise, the increased force for rotating the lever 3 can immediately bring about the completely mated state, without once stopping the lever 3 in the main circuit mated state.

Figure 12B:
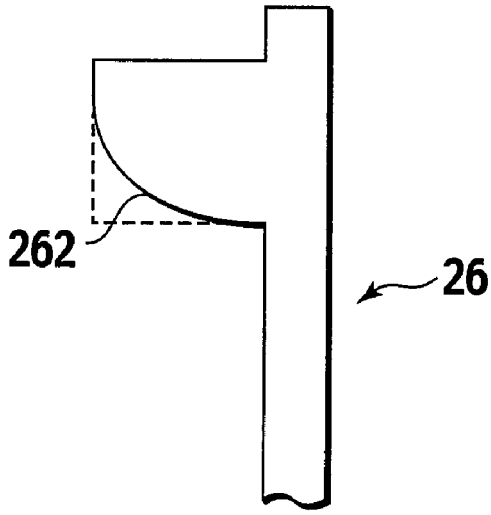

Contrary to the above, as shown in FIG. 12B, forming a lower part of the nail part 262 into an alphabetical R can eliminate the need of pushing with the finger the locking member 26 from the completely mated state to the completely detached state, thus smoothly bringing the SDSW 100 into the detached state.

Figure 13:
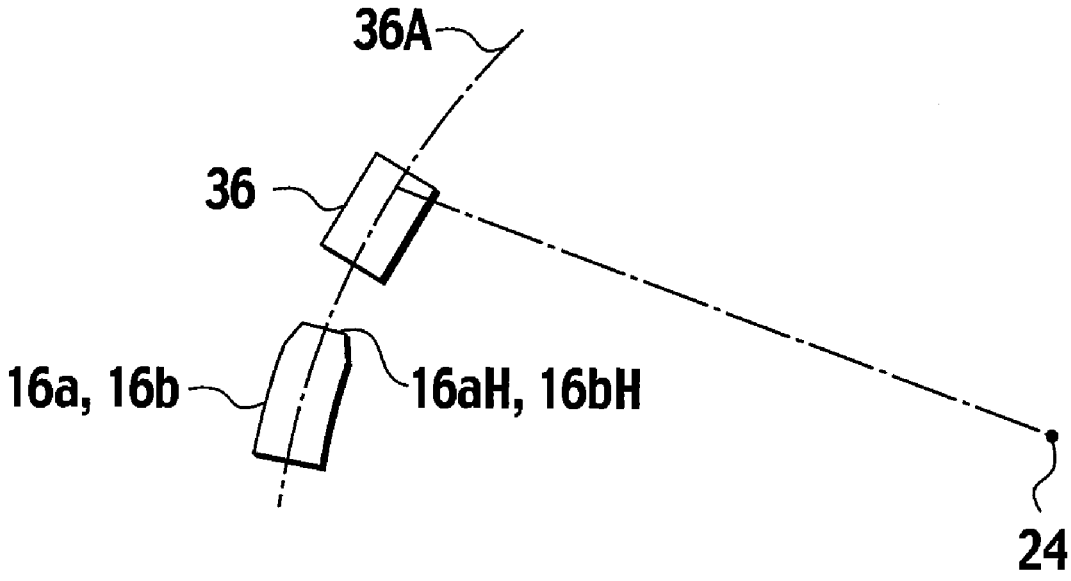
FIG. 13 shows an example of deforming the terminals.

With the lever 3 configured to rotate around the rotary shaft 24, the second switch terminal 36 moves along an arc track 36A. Then, as shown in FIG. 13, head end parts 16*a*H, 16*b*H of the respective terminals 16*a*, 16*b* of the connector part 12 of the first housing 1 may be provided along the rotation track (arc track 36A) of the terminal 36. As such, the terminal 36 mates straightly with the head end parts 16*a*H, 16*b*H of the respective terminals 16*a*, 16*b*.

Therefore, in the mating operation, the terminals 16*a*, 16*b* can be prevented from being deviated from the connector part 12 and the terminal 36 can be prevented from being deviated from the connector part 34, which deviations may be caused with an excessive force applied to the terminals 16*a*, 16*b*, 36.

Besides, according to embodiment, the guide groove 35 is formed in the arm plate 31 of the lever 3 and the guide pin 13 is allowed to engage the guide groove 35. As such, the rotation of the lever 3 allows the second housing 2 to mate with or to be detached from the first housing 1.

The mating-detaching mechanism (including the guide pin 13 and the guide groove 35) is, however, not limited to the above structure.

Moreover, the first housing 1 includes a pair of the terminals 14*a*, 14*b* as the main circuit terminals, and a pair of the terminals 16*a*, 16*b* as the mated state sensor terminals.

Meanwhile, the second housing 2 includes the terminals 27*a*, 27*b* as the first switch terminals, and the terminal 36 as the second switch terminal.

The configuration of each of the terminals 14*a*, 14*b*, 16*a*, 16*b*, 27*a*, 27*b*, 36 is not limited to the above.

The structure of the SDSW 100 is not limited to the above described as long as the following operations are implemented.

The lever 3 is rotated to the main circuit mated position (first certain position P1) to thereby connect the main circuit terminal 14*a* with the first switch terminal 27*a* and connect the main circuit terminal 14*b* with the first switch terminal 27*b*, thus connecting the main circuit terminals 14*a*, 14*b* with each other and connecting the first switch terminals 27*a*, 27*b* with each other.

Then, the lever 3 is rotated to the completely mated position (second certain position P2) to thereby connect the second switch terminal 36 with the mated state sensor terminal 16*a* and with the mated state sensor terminal 16*b*, thus connecting the mated state sensor terminals 16*a*, 16*b* with each other.

The above operations bring the power supply circuit 10 into the conduction state.

Moreover, the locking member 26 serves as the movable member 26, such that the elastic deformation of the locking member 26 locks the lever 3. The structure and operation of the lock mechanism are, however, not limited to the above.

The configuration of the connector parts, that is, the receiving connector part 12 and the inserted connector part 34 having respectively the mated state sensor terminals 16*a*, 16*b* and the second switch terminal 36 is not limited to the above described.

That is, as long as the feature, function and the like of the present invention can be accomplished, the present invention is not limited to the power supply circuit connector 100 according to the embodiment.

This application is based on a prior Japanese Patent Application No. P2007-007737 (filed on Jan. 17, 2007 in Japan). The entire contents of the Japanese Patent Application No. P2007-007737 from which priority is claimed are incorporated herein by reference, in order to take some protection against translation errors or omitted portions.

The scope of the present invention is defined with reference to the following claims.

What is claimed is:

1. A power supply circuit connector of a power supply circuit, the power supply circuit connector comprising:

a first housing including:

a pair of main circuit terminals configured to be connected with each other via a first switch terminal, for bringing the power supply circuit into a conduction state, and a pair of mated state sensor terminals configured to be connected with each other, for bringing the power supply circuit into the conduction state;

a second housing configured to mate with or to be detached from the first housing, wherein the second housing includes the first switch terminal configured to connect the pair of the main circuit terminals by a lever being rotated to a first certain position;

the lever rotatably supported to the second housing, wherein the lever includes a second switch terminal configured to, in a state that the pair of the main circuit terminals are kept connected with each other, connect the pair of the mated state sensor terminals with each other by the lever being rotated to a second certain position after the first certain position; and a mating-detaching mechanism configured to, by the rotated lever, mate the second housing with the first housing, and detach the second housing from the first housing, wherein at least a head end part of each of the mated state sensor terminals extends along a rotation track of the second switch terminal.

2. The power supply circuit connector according to claim 1, wherein the head end part of each of the mated state sensor terminals extends along the rotation track of the second switch terminal such that the mated state sensor terminals become connected only by rotation of the lever.

3. The power supply circuit connector according to claim 1, further comprising a locking member configured to lock the lever in the second certain position.

4. The power supply circuit connector according to claim 3, wherein the locking member includes a movable member configured to:

move from a rotation track of the lever to an area out of the rotation track of the lever, to thereby rotate the lever from the first certain position to the second certain position, and move from the area out of the rotation track of the lever to the rotation track of the lever, to thereby stop the lever from rotating from the second certain position to the first certain position.

5. The power supply circuit connector according to claim 3, wherein the locking member is elastic.

6. The power supply circuit connector according to claim 5, wherein the elastic locking member is elastically deformable rearward.

7. The power supply circuit connector according to claim 5, wherein the elastic locking member is a single member.

8. The power supply circuit connector according to claim 1, wherein a head end part of the lever has an inserted connector part having an opening end face that is open at least in a direction of the rotated lever, wherein the second switch terminal is provided in the inserted connector part such that the second switch terminal does not protrude from the opening end face of the inserted connector part, wherein the first housing has a receiving connector part configured to receive the inserted connector part, and wherein the mated state sensor terminals are provided in the receiving connector part such that the mated state sensor terminals do not protrude from an opening end face of the receiving connector part.

9. The power supply circuit connector according to claim 8, wherein, on a side end face of the inserted connector part on a side of a rotary shaft of the lever, an opening part is defined continuously with the opening end face of the inserted connector part which is open.

10. A power supply circuit connector of a power supply circuit, the power supply circuit connector comprising:

a housing including:

a first switch terminal configured to connect a pair of main circuit terminals of another housing by a lever rotated to a first certain position, and a pair of mated state sensor terminals configured to be connected with each other;

the lever rotatably supported to the housing, wherein the lever includes a second switch terminal having a first part and a second part defining therebetween an inner width which is narrower downward in a right-and-left direction, wherein a lower end part of the second switch terminal is elastically deformable around an upper end part of the second switch terminal on right and left sides; and a guide groove defined in the lever and to which a guide pin is inserted, wherein at least a head end part of each of the mated state sensor terminals extends along a rotation track of the second switch terminal.

11. The power supply circuit connector according to claim 10, wherein the head end part of each of the mated state sensor terminals extends along the rotation track of the second switch terminal such that the mated state sensor terminals become connected only by rotation of the lever.

12. The power supply circuit connector according to claim 10, further comprising a locking member configured to lock the lever in a second certain position after the first certain position.

13. The power supply circuit connector according to claim 12, wherein the locking member is elastic.

14. The power supply circuit connector according to claim 13, wherein the elastic locking member is elastically deformable rearward.

15. The power supply circuit connector according to claim 13, wherein the elastic locking member is a single member.

* * * * *